US007190212B2

(12) United States Patent
Shor et al.

(10) Patent No.: US 7,190,212 B2
(45) Date of Patent: Mar. 13, 2007

(54) POWER-UP AND BGREF CIRCUITRY

(75) Inventors: Joseph S. Shor, Tel Mond (IL); Yoram Betser, Mazkeret Batya (IL); Yair Sofer, Tel-Aviv (IL)

(73) Assignee: Saifun Semiconductors Ltd, Netanya (IL)

( * ) Notice: Subject to any disclaimer, the term of this patent is extended or adjusted under 35 U.S.C. 154(b) by 0 days.

(21) Appl. No.: 10/862,401

(22) Filed: Jun. 8, 2004

(65) Prior Publication Data

US 2005/0270089 A1 Dec. 8, 2005

(51) Int. Cl.
*G05F 1/10* (2006.01)

(52) U.S. Cl. ..... 327/539; 327/143; 327/563; 327/75; 327/407

(58) Field of Classification Search ..... 327/74, 327/75, 76, 142, 143, 407, 408, 411, 534, 327/535, 539, 561, 562, 563
See application file for complete search history.

(56) References Cited

U.S. PATENT DOCUMENTS

| | | | |
|---|---|---|---|
| 4,961,010 | A | 10/1990 | Davis |
| 5,029,063 | A | 7/1991 | Lingstaedt et al. |
| 5,081,371 | A | 1/1992 | Wong |
| 5,142,495 | A | 8/1992 | Canepa |
| 5,142,496 | A | 8/1992 | Van Buskirk |
| 5,276,646 | A | 1/1994 | Kim et al. |
| 5,280,420 | A | 1/1994 | Rapp |
| 5,381,374 | A | 1/1995 | Shiraishi et al. |
| 5,534,804 | A | 7/1996 | Woo |
| 5,553,030 | A | 9/1996 | Tedrow et al. |
| 5,559,687 | A | 9/1996 | Nicollini et al. |
| 5,581,252 | A | 12/1996 | Thomas |
| 5,612,642 | A | 3/1997 | McClintock |
| 5,636,288 | A | 6/1997 | Bonneville et al. |
| 5,663,907 | A | 9/1997 | Frayer et al. |
| 5,672,959 | A | 9/1997 | Der |
| 5,675,280 | A | 10/1997 | Nomura et al. |
| 5,708,608 | A | 1/1998 | Park et al. |
| 5,717,581 | A | 2/1998 | Canclini |
| 5,726,946 | A | 3/1998 | Yamagata et al. |
| 5,760,634 | A | 6/1998 | Fu |
| 5,808,506 | A | 9/1998 | Tran |
| 5,815,435 | A | 9/1998 | Van Tran |
| 5,847,441 | A | 12/1998 | Cutter et al. |

(Continued)

FOREIGN PATENT DOCUMENTS

| | | |
|---|---|---|
| EP | 0693781 | 1/1996 |

(Continued)

OTHER PUBLICATIONS

Martin, "Improved Circuits for the Realization of Switched-Capacitor Filters", IEEE Transactions on Circuits and Systems, Apr. 1980, pp. 237-244, vol. CAS-27.

(Continued)

*Primary Examiner*—Jeffrey Zweizig
(74) *Attorney, Agent, or Firm*—Eitan Law Group

(57) ABSTRACT

Circuitry including a BGREF (bandgap voltage reference) comparator including a plurality of MOS transistors that compare a resistor divided supply voltage to a function of at least two process parameter voltages.

8 Claims, 4 Drawing Sheets

U.S. PATENT DOCUMENTS

| | | | | |
|---|---|---|---|---|
| 5,880,620 | A | 3/1999 | Gitlin et al. | |
| 5,903,031 | A | 5/1999 | Yamada et al. | |
| 5,910,924 | A | 6/1999 | Tanaka et al. | |
| 5,946,258 | A | 8/1999 | Evertt et al. | |
| 5,963,412 | A | 10/1999 | En | |
| 6,005,423 | A | 12/1999 | Schultz | |
| 6,028,324 | A | 2/2000 | Su et al. | |
| 6,040,610 | A | 3/2000 | Noguchi et al. | |
| 6,064,226 | A * | 5/2000 | Earl | 326/68 |
| 6,064,251 | A | 5/2000 | Park | |
| 6,075,402 | A | 6/2000 | Ghilardelli et al. | |
| 6,081,456 | A | 6/2000 | Dadashev | |
| 6,094,095 | A | 7/2000 | Murray et al. | |
| 6,107,862 | A | 8/2000 | Mukainakano et al. | |
| 6,118,207 | A | 9/2000 | Ormerod et al. | |
| 6,130,572 | A | 10/2000 | Ghilardelli et al. | |
| 6,130,574 | A | 10/2000 | Bloch et al. | |
| 6,150,800 | A | 11/2000 | Kinoshita et al. | |
| 6,154,081 | A | 11/2000 | Pakkala et al. | |
| 6,157,242 | A | 12/2000 | Fukui | |
| 6,188,211 | B1 | 2/2001 | Rincon-Mora et al. | |
| 6,198,342 | B1 | 3/2001 | Kawai | |
| 6,208,200 | B1 | 3/2001 | Arakawa | |
| 6,246,555 | B1 | 6/2001 | Tham | |
| 6,252,442 | B1 * | 6/2001 | Malherbe | 327/143 |
| 6,285,614 | B1 | 9/2001 | Mulatti et al. | |
| 6,297,974 | B1 | 10/2001 | Ganesan et al. | |
| 6,339,556 | B1 | 1/2002 | Watanabe | |
| 6,353,356 | B1 | 3/2002 | Liu | |
| 6,356,469 | B1 | 3/2002 | Roohparvar et al. | |
| 6,359,501 | B2 | 3/2002 | Lin et al. | |
| 6,400,209 | B1 | 6/2002 | Matsuyama et al. | |
| 6,433,624 | B1 | 8/2002 | Grossnickle et al. | |
| 6,452,438 | B1 | 9/2002 | Li | |
| 6,577,514 | B2 | 6/2003 | Shor et al. | |
| 6,608,526 | B1 | 8/2003 | Sauer | |
| 6,614,295 | B2 | 9/2003 | Tsuchi | |
| 6,627,555 | B2 | 9/2003 | Eitan et al. | |
| 6,654,296 | B2 | 11/2003 | Jang et al. | |
| 6,665,769 | B2 | 12/2003 | Cohen et al. | |
| 6,677,805 | B2 | 1/2004 | Shor et al. | |
| 2002/0145465 | A1 | 10/2002 | Shor et al. | |
| 2003/0076159 | A1 | 4/2003 | Shor et al. | |
| 2003/0202411 | A1 | 10/2003 | Yamada | |
| 2004/0151034 | A1 | 8/2004 | Shor et al. | |
| 2005/0140405 | A1 * | 6/2005 | Do et al. | 327/143 |

FOREIGN PATENT DOCUMENTS

| | | |
|---|---|---|
| EP | 0 843 398 | 5/1998 |
| JP | 020001118392 | 4/2001 |

OTHER PUBLICATIONS

Klinke. et al , "A Very-High-Slew-Rate CMOS Operational Amplifier", IEEE Journal of Solid-State Circuits, 1989, pp. 744-746, vol. 24.

Shor, et al., "paper WA2 04.01—Self regulated Four-Phased Charge Pump with Boosted Wells", ISCAS 2002 2002.

Fotouhi, "An Efficient CMOS Line Driver for 1.544-Mb/s T1 and 2 048-Mb/s E1 Applications". IEEE Journal of Solid-State Circuits, 2003, pp. 226-236, vol. 38.

* cited by examiner

POWER-UP AND BGREF CIRCUITRY

FIELD OF THE INVENTION

The present invention relates generally to power-up circuits, and particularly to power-up circuits used to turn on BGREF (bandgap voltage reference) circuits, and BGREF level comparators.

BACKGROUND OF THE INVENTION

In many types of non-volatile memory (NVM) cells, such as flash memory or electrically erasable, programmable read only memory (EEPROM), an example of which is a nitride, read only memory (NROM), reading data stored in the memory cell should be performed at a known minimum VDD voltage. For example, but not necessarily, the read voltage should be not less than 2.4V. Below this voltage, charge pump circuits, sense amplifiers, regulator circuits, and the NROM cell itself may not function properly, resulting in incorrect data and margin loss. Thus, it is desirable that the circuitry (chip) should have internal circuit to detect that VDD has reached the required minimum value.

Reference is now made to FIG. 1, which illustrates a prior art circuit for detecting that VDD is greater than a minimum value (e.g., VDD>2.4V). This circuit is also called an accurate power-up comparator or accurate level comparator or accurate comparator. The circuit compares a reference voltage, BGREF (bandgap voltage reference), to a resistor divider 5 from VDD. The resistor divider 5 comprises two resistors R1 and R2 connected in series at a node n1. The comparator comprises a differential pair of NMOS (n-channel metal oxide semiconductor) transistors M1 and M2, a tail current source I1, and a current mirror (active load) that includes PMOS (p-channel metal oxide semiconductor) transistors M4 and M5.

In the current mirror (active load), the gates of PMOS transistors M4 and M5 are connected to each other, and the drain of PMOS transistor M5 is connected to its gate. The sources of PMOS transistors M4 and M5 may be connected to a reference voltage, such as VDD.

The gate of NMOS transistor M2 is connected to BGREF, whereas the gate of NMOS transistor M1 is connected to node n1. The sources of NMOS transistors M1 and M2 are connected to current source I1. The drain of NMOS transistor M2 is connected to the drain of PMOS transistor M4 via a node n2 and the drain of NMOS transistor M1 is connected to the drain of PMOS transistor M5 via a node n3.

Two inverters 6 and 7 buffer the comparator output OPC (from node n2) to the general output OP. Inverter 6 is connected to the drain of PMOS transistor M4 via node n2 and the output of inverter 7 is connected to the input of inverter 6.

In this particular example, the value of resistor R1 is identical to that of resistor R2, and BGREF equals 1.2V. For these values, the node OPC is at a low voltage, close to GND for VDD<2.4. When VDD>2.4V, node n1 is greater than BGREF, and the current in NMOS transistor M1 is greater than the current in NMOS transistor M2. The current in NMOS transistor M1 is mirrored from PMOS transistor M5 to PMOS transistor M4, which forces the comparator output OPC to a high state, close to VDD. The inverters 6 and 7 buffer this signal to the general output OP, which is a logical signal indicating that VDD>2.4 when it is high.

In order to function properly, the accurate comparator assumes that BGREF is at a stable voltage, meaning that VDD is sufficiently high to allow BGREF to function.

Reference is now made to FIG. 2, which illustrates a prior art BGREF circuit. The BGREF circuit is connected to power-up circuit 8 (also referred to as start-up circuitry or a BGREF level comparator), used to indicate that VDD has reached a level at which BGREF can operate. Power-up circuit 8 is shown and described hereinbelow with reference to FIG. 3.

The illustrated BGREF circuit comprises three branches, headed by PMOS transistors XA1A, XA1B and XA1C, whose sources are all connected to VDD. PMOS transistors XA1A and XA1B form a current mirror, wherein the gates of PMOS transistors XA1A and XA1B are connected together and the drain of PMOS transistor XA1B is connected to its gate. The gate of PMOS transistor XA1A is connected to the power-up circuit 8. The drains of PMOS transistors XA1A and XA1B are connected to the drains of NMOS transistors XA2A and XA2B.

NMOS transistors XA2A and XA2B form a current mirror, wherein the gates of NMOS transistors XA2A and XA2B are connected together and the drain of NMOS transistor XA2A is connected to its gate, which is also connected to the power-up circuit 8. The source of NMOS transistor XA2A is connected to a diode D1. The source of NMOS transistor XA2B is connected to a diode D2 via a resistor R1.

The gate of PMOS transistors XA1C is connected to the gate of PMOS transistor XA1B. The drain of PMOS transistor XA1C is connected to a diode D3 via a resistor R2. The output of the BGREF circuit is designated as OP.

As is known in the art, in order for the BGREF circuit to turn on, VDD must be sufficiently high for each transistor and diode in the circuit to turn on. For a transistor to turn on, its Vgs (gate-source voltage) must be above Vtn (threshold for NMOS) or Vtp (threshold for PMOS), which may be 0.7V (although not necessarily this value). The Vtn and Vtp parameters are very process dependent and can vary independently of each other. The transistor Vgs must have sufficient overdrive (Vdsat), which may be 0.2V, to drive its current. The transistor Vds (drain-source) voltage must be above Vdsat to be in the saturation regime. The diode voltages must be above Vd, which may be 0.7V.

Thus in the branch of PMOS transistor XA1A, VDD must be above Vtn+Vd+2*Vdsat. For the PMOS transistor XA1B branch, VDD>Vtp+Vd+2*Vdsat. In the output branch of PMOS transistor XA1C, the output should be at 1.2V, thus VDD>1.2V +Vdsat. It is apparent that Vtn, Vtp, and Vd all may play a critical role in determining the minimum supply voltage of the BGREF.

Reference is now made to FIG. 3, which illustrates a prior-art power-up circuit, used to indicate that VDD has reached a level at which BGREF can operate. The circuit may be identical to that of FIG. 1, except that the gate of NMOS transistor M2 is connected to the gate of an NMOS transistor M3. The NMOS transistors M2 and M3 form a current mirror in the more general meaning, wherein the drain of NMOS transistor M3 is connected to its gate but the source of M3 is connected to ground, while as mentioned above the source of M2 can be connected to a current source I1. The drain of NMOS transistor M3 is connected to a current source I2 at a node n4. The current source I2 may be connected to a reference voltage, such as VDD.

The circuitry of FIG. 3 compares Vtn of NMOS transistor M3 to VDD divided by the resistor divider 5. The comparator output flips, trips or changes state when VDD is a multiple of Vtn. The resistor divider 5 can be scaled such that the trip point of the comparator is close to the operating VDD of the BGREF circuit in FIG. 2. This trip point is typically between 1.6V and 2.3V. The trip point can be designed to be arbitrarily large, by changing the resistor divider 5. However, it is necessary to keep the trip point sufficiently below the minimum operating VDD voltage of the chip.

It is clear that the circuit of FIG. 3 depends only on Vtn, while the operating VDD voltage of the BGREF in FIG. 2 depends on the Vtn, Vtp, and Vd. Thus, there are situations where Vtn is small and Vtp, Vd are large. In these cases, the comparator flips at a voltage where BGREF is not yet ready. This can result in the accurate comparator giving an erroneous reading, resulting in an incorrect first read.

SUMMARY OF THE INVENTION

The present invention seeks to provide a novel power-up system and BGREF level comparator, as is described more in detail hereinbelow. In one embodiment, the present invention seeks to provide a BGREF level comparator whose trip point is a function of all of the parameters in BGREF, and is scaled to BGREF in all process corners, providing a logical signal that BGREF has sufficient VDD voltage to be operational.

There is thus provided in accordance with an embodiment of the present invention circuitry including a BGREF comparator including a plurality of MOS transistors (e.g., a differential pair of NMOS transistors) that compare a resistor divided supply voltage to a function (e.g., an average or weighted average) of at least two process parameter voltages.

In accordance with an embodiment of the present invention the process parameter voltages include a threshold voltage Vtn for an NMOS transistor of a BGREF circuit, a threshold voltage Vtp for a PMOS transistor of the BGREF circuit, and a diode voltage Vd of the BGREF circuit.

Further in accordance with an embodiment of the present invention one or more legs of the differential pair may be degenerate, and one or more branches of the degenerate leg may receive a process parameter voltage at its input.

Still further in accordance with an embodiment of the present invention a power-up circuit is provided to turn on a BGREF circuit at a supply voltage at which the BGREF circuit is operational. The BGREF comparator and the power-up circuit may power up a non-volatile memory circuit to perform a read operation.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 4:
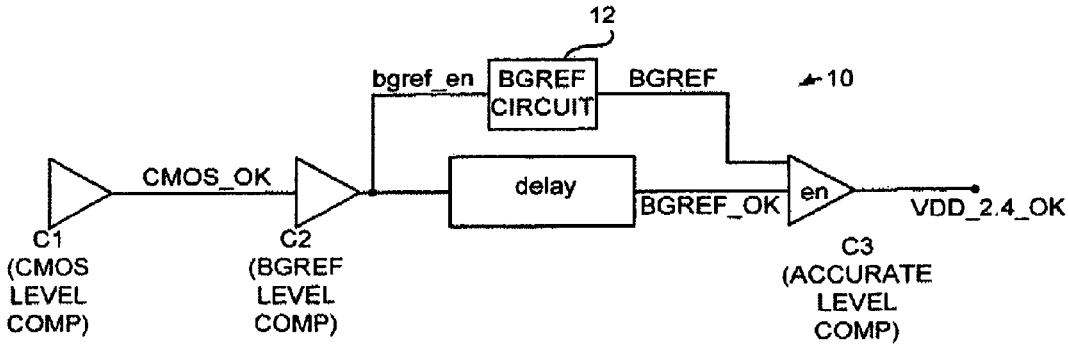
FIG. 4 is a simplified block diagram of a power-up system, constructed and operative in accordance with an embodiment of the invention.

Reference is now made to FIG. 4, which illustrates a simplified block diagram of a power-up system 10, constructed and operative in accordance with an embodiment of the present invention. Power-up system 10 may be useful for powering up a chip (not shown), such as but not limited to, a chip with NROM cells.

Figure 1:
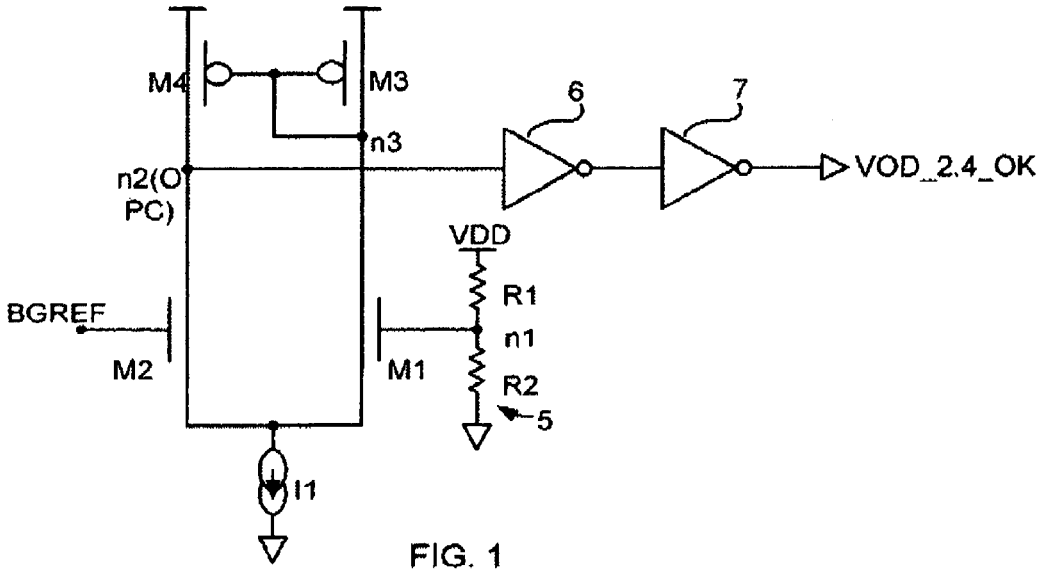
FIG. 1 Prior Art
FIG. 1 is a simplified circuit diagram of a prior art circuit for detecting that VDD is greater than a minimum value.
Figure 2:
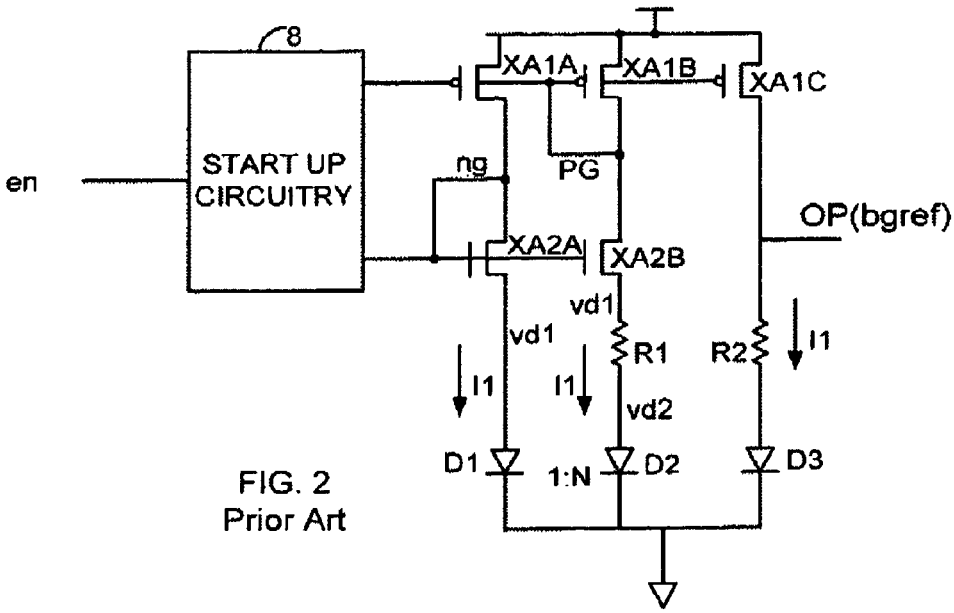
FIG. 2 Prior Art
FIG. 2 is a simplified circuit diagram of a prior art BGREF circuit.

Power-up system 10 may comprise a CMOS (complementary metal oxide semiconductor) level comparator C1 whose output is input to a BGREF level comparator C2, described hereinbelow with reference to FIG. 5. The output of BGREF level comparator C2 is input to an accurate level comparator C3, and to a BGREF circuit 12. The output of BGREF circuit 12 is input to comparator C3. Although not necessarily, the BGREF circuit 12 may be identical to the BGREF circuit of FIG. 2, and the accurate level comparator C3 may be identical to the accurate level comparator of FIG. 1. Alternatively, the BGREF circuit 12 may be some scale of the BGREF circuit of FIG. 2, being dependent on the same process parameters.

The circuitry of CMOS level comparator C1 is well known in the art. Some examples include those described in U.S. Pat. Nos. 5,534,804; 5,612,642 or 6,005,423.

CMOS level comparator C1 may provide a reset for the chip and for all of the comparators in the power-up system 10 when VDD is less than the threshold voltage Vt. This reset may be necessary, because below the threshold voltage Vt, all voltages in the chip are not well defined. When VDD is sufficiently above Vt, the CMOS level comparator C1 provides a signal cmos_ok, which indicates that the BGREF level comparator C2 can turn on. The BGREF level comparator C2 outputs a logical signal bgref_ok at a VDD level at which the BGREF circuit 12 may function. Upon output of the logical signal bgref_ok, the BGREF circuit 12 becomes enabled, and the accurate level comparator C3 becomes enabled.

There may be a small delay (maybe 1 μs) between enabling of the BGREF circuit 12 and enabling of the accurate level comparator C3 to allow BGREF to turn on. The accurate comparator outputs an OK signal VDD_2.4_OK when VDD>2.4V.

Figure 3:
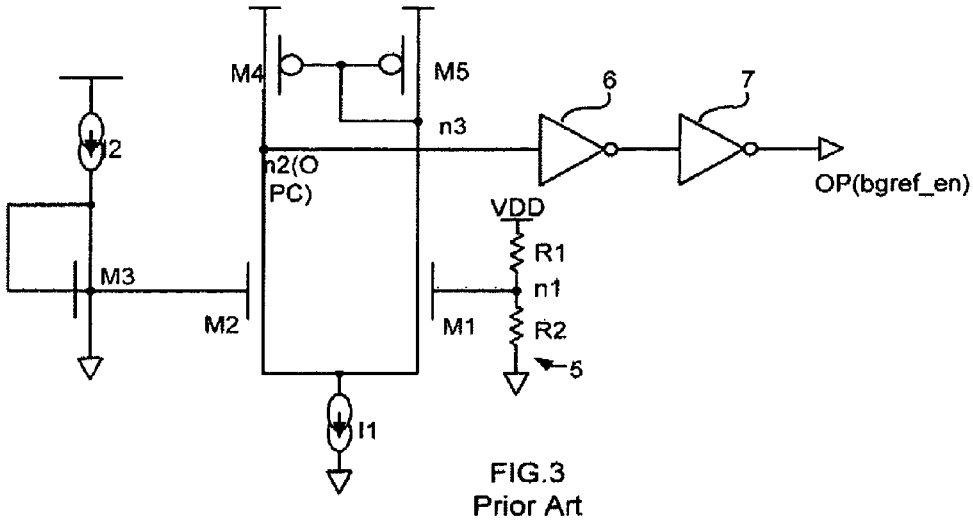
FIG.3 Prior Art
FIG. 3 is a simplified circuit diagram of a prior-art power-up circuit, used to indicate that VDD has reached a level at which BGREF can operate.
Figure 5:
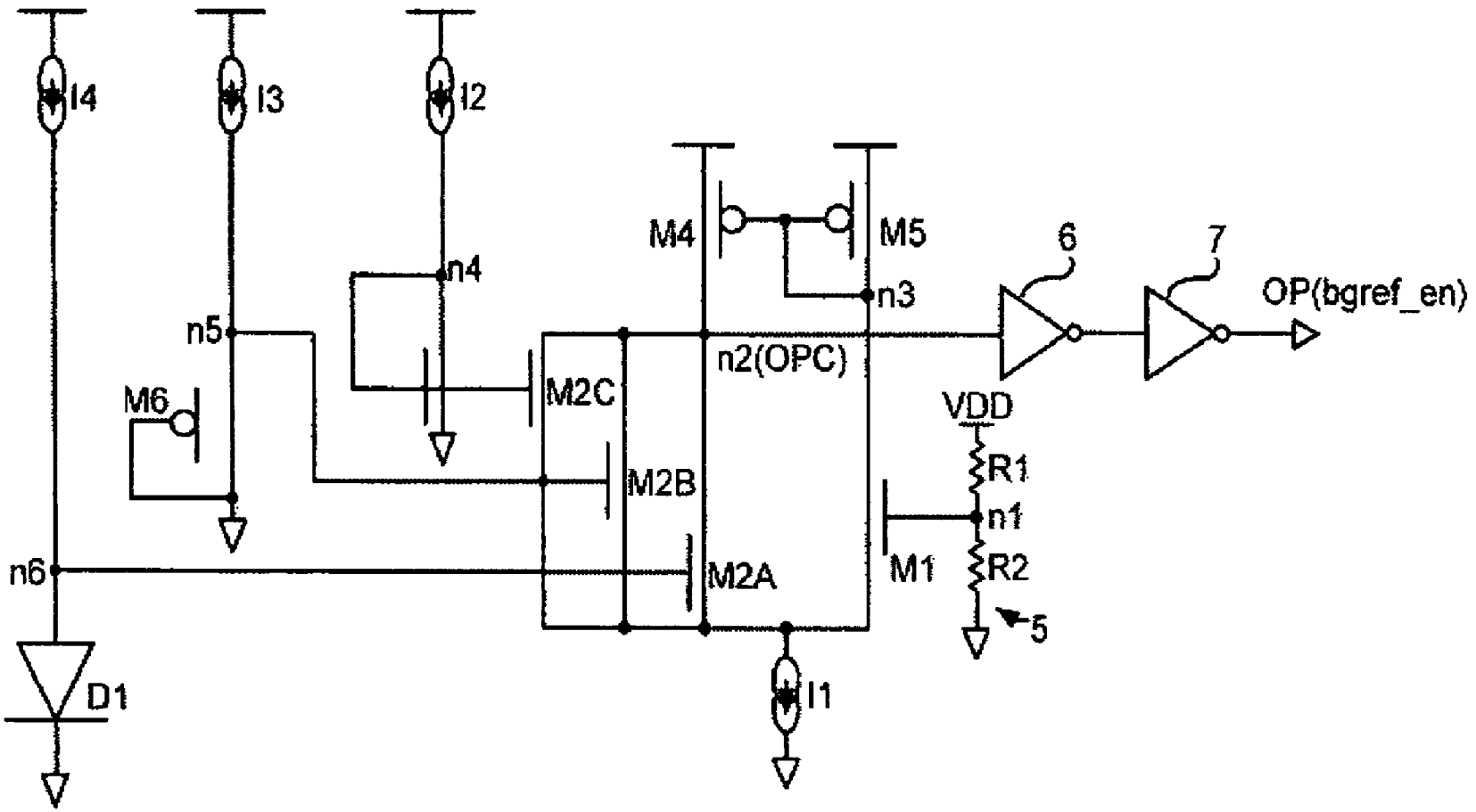
FIG. 5 is a simplified circuit diagram of a BGREF level comparator, constructed and operative in accordance with an embodiment of the present invention.

Reference is now made to FIG. 5, which illustrates BGREF level comparator C2, constructed and operative in accordance with an embodiment of the present invention. Components of the circuitry of FIG. 5 that are similar to that of FIG. 3 are designated with the same reference labels, and the description is not repeated for the sake of brevity.

In the illustrated embodiment of BGREF level comparator C2, NMOS transistor M2 (FIG. 3) is replaced with an NMOS transistor M2C. Two more NMOS transistors M2B and M2A are provided. The drains of NMOS transistors M2A, M2B and M2C are all connected via node n2, and all their sources are connected to current source I1. The gate of NMOS transistor M2B is connected to a current source I3 via a node n5. The gate of NMOS transistor M2A is connected to a current source I4 via a node n6. A PMOS transistor M6 has its gate and drain connected together to ground. The source of PMOS transistor M6 is connected to current source I3 via node n5. A diode D1 is connected to current source I4 via node n6 and is grounded.

BGREF level comparator C2 compares a resistor divided VDD to a function of Vtn, Vtp and Vd. The illustrated embodiment compares the resistor divided VDD to an average or a weighted average of Vtn, Vtp and Vd, but the invention is not limited to an average and other functions may be used. In the illustrated embodiment, the comparison may be accomplished by using a differential pair with a degenerate leg. The differential pair is formed by NMOS transistor M1 on one side and a degenerate leg comprising NMOS transistors M2A, M2B and M2C on the other side. Each of the NMOS transistors M2A, M2B and M2C are referred to as the branches of the degenerate leg.

The current of the degenerate leg M2A depends on the voltage level at node n6, which in turn depends on the process parameter Vd. The current of the degenerate leg M2B depends on the voltage at node n5, which in turn depends on the process parameter Vtp. The current of the degenerate leg M2C depends on the voltage at node n4, which in turn depends on the process parameter Vtn.

The trip point of BGREF level comparator C2 may occur when the current in NMOS transistor M1 equals the sum of the currents in NTMOS transistors M2A, M2B and M2C. In general, the BGREF level comparator C2 may compare the resistor divided VDD to some mathematical function of Vtn, Vtp and Vd. Depending on the relative values of NMOS transistors M2A, M2B and M2C, the mathematical function may be a type of average. For example, it is possible to make the mathematical function a weighted average by adjusting the ratios of NMOS transistors M2A, M2B and M2C.

Figure 6:
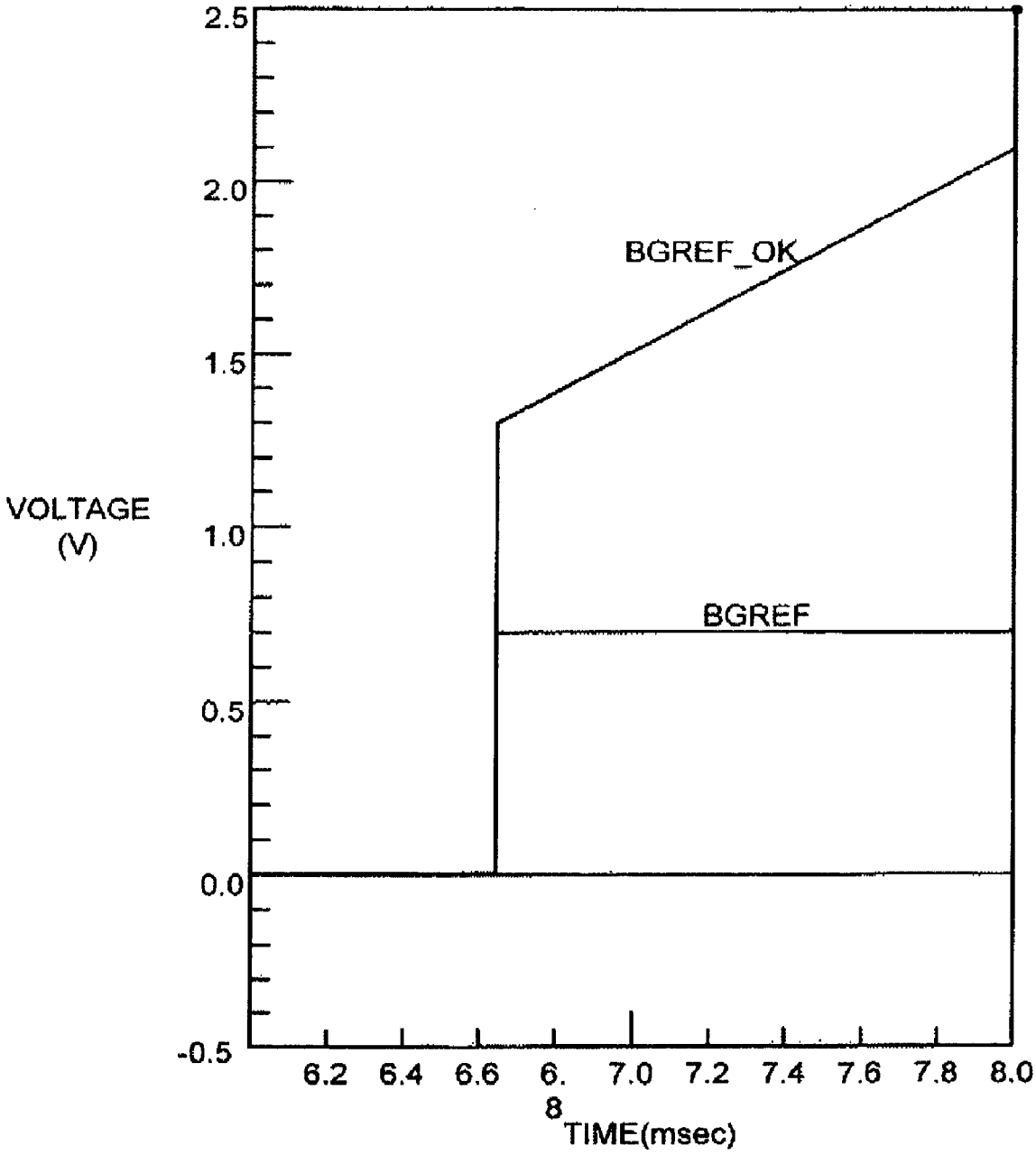
FIG. 6 is a simplified graphical illustration of a simulation of the BGREF level comparator and the BGREF circuit, in accordance with an embodiment of the present invention.

Reference is now made to FIG. 6, which illustrates a simulation of the BGREF level comparator C2 and the BGREF circuit 12. FIG. 6 shows the BGREF and bgref_ok signals. When the bgref_ok signal rises it enables the BGREF circuit 12. The BGREF signal is capable of reaching its full value at this point. This will be true in all process corners and conditions.

It will be appreciated by person skilled in the art that variations of the embodiment described above are possible within the scope of the invention. For example, it is possible to design the BGREF level comparator C2 using a degenerate leg with just two transistors (instead of all three transistors M2A, M2B and M2C), and use only two of the process parameters Vd, Vtn, and Vtp. Such a BGREF level comparator would be useful for other BGREF architectures using only those two parameters. It is further possible to design the BGREF level comparator C2 using a degenerate leg with more than three transistors. It is also possible to increase the degeneracy of the leg and add process parameters.

It will be appreciated by person skilled in the art, that the present invention is not limited by what has been particularly shown and described herein above. Rather the scope of the present invention is defined only by the claims that follow:

What is claimed is:

1. Circuitry comprising: a BGREF (bandgap voltage reference) level comparator comprising a plurality of MOS (metal oxide semiconductor) transistors that compare a process independent divided supply voltage to a function of at least two process parameter dependent voltages.

2. The circuitry according to claim 1, wherein said process parameter dependent voltages comprise a threshold voltage Vtn for an NMOS transistor of a BGREF circuit, a threshold voltage Vtp for a PMOS transistor of the BGREF circuit, and a diode voltage Vd of the BGREF circuit.

3. The circuitry according to claim 1, wherein said MOS transistors comprise a differential pair of NMOS (n-channel metal oxide semiconductor) transistors.

4. The circuitry according to claim 1, wherein said function is an average.

5. The circuitry according to claim 1, wherein said function is a weighted average.

6. The circuitry according to claim 3, wherein at least one leg of said differential pair is degenerate.

7. The circuitry according to claim 6, wherein at least one branch of said degenerate leg receives a process parameter voltage at its input.

8. The circuitry according to claim 1, further comprising: a resistor divider including two resistors R1 and R2 connected in series at a node n1, an NMOS transistors M1 whose gate is connected to node n1, a current source I1, wherein the source of NMOS transistors M1 is connected to the current source I1; a current mirror that includes PMOS transistors M4 and M5, wherein the gates of PMOS transistors M4 and M5 are connected to each other, the drain of PMOS transistor M5 is connected to its gate, and the sources of PMOS transistors M4 and M5 are connected to a voltage VDD, and the drain of NMOS transistor M1 is connected to the drain of PMOS transistor M5 via a node n3; a first inverter connected to the drain of PMOS transistor M4 via a node n2, the output of the first inverter being connected to the input of a second inverter whose output is a general output OP; NMOS transistors M2A, M2B and M2C whose drains are all connected together via the node n2, and all their sources are connected to the current source I1, wherein the gate of NMOS transistor M2C is connected to the gate of an NMOS transistor M3, the drain of NMOS transistor M3 being connected to its gate and to a current source I2, the current source I2 being connected to a reference voltage, wherein the gate of NMOS transistor M2B is connected to a current source I3, and the gate of NMOS transistor M2A is connected to a current source I4; and a PMOS transistor M6 whose gate and drain are connected together to ground, and whose source is connected to current source I3, and a grounded diode D1 connected to current source I4.

* * * * *